US009080436B2

(12) United States Patent
Tetzlaff et al.

(10) Patent No.: US 9,080,436 B2
(45) Date of Patent: Jul. 14, 2015

(54) CONNECTION ASSEMBLY FOR THROUGH TUBING CONVEYED SUBMERSIBLE PUMPS

(75) Inventors: Steven K. Tetzlaff, Owasso, OK (US); Lance Robinson, Tulsa, OK (US)

(73) Assignee: Baker Hughes Incorporated, Houston, TX (US)

( * ) Notice: Subject to any disclaimer, the term of this patent is extended or adjusted under 35 U.S.C. 154(b) by 910 days.

(21) Appl. No.: 13/297,979

(22) Filed: Nov. 16, 2011

(65) Prior Publication Data

US 2012/0152563 A1 Jun. 21, 2012

Related U.S. Application Data

(60) Provisional application No. 61/424,937, filed on Dec. 20, 2010.

(51) Int. Cl.
*E21B 43/00* (2006.01)
*E21B 43/12* (2006.01)

(52) U.S. Cl.
CPC ..... *E21B 43/128* (2013.01)

(58) Field of Classification Search
None
See application file for complete search history.

(56) References Cited

U.S. PATENT DOCUMENTS

| | | | | |
|---|---|---|---|---|
| 4,350,911 | A | 9/1982 | Wilson et al. | |
| 4,409,504 | A * | 10/1983 | Wilson et al. | 310/87 |
| 6,705,402 | B2 | 3/2004 | Proctor | |
| 7,549,849 | B2 * | 6/2009 | Watson et al. | 417/414 |
| 7,677,320 | B2 * | 3/2010 | Shaw et al. | 166/368 |
| 2007/0224057 | A1 | 9/2007 | Swatek et al. | |
| 2009/0202371 | A1 | 8/2009 | Green | |
| 2009/0291001 | A1 | 11/2009 | Neuroth et al. | |
| 2010/0150751 | A1 | 6/2010 | Merrill et al. | |

* cited by examiner

*Primary Examiner* — Jennifer H Gay
*Assistant Examiner* — Caroline Butcher
(74) *Attorney, Agent, or Firm* — Bracewell & Giuliani LLP

(57) ABSTRACT

An electrical submersible pumping (ESP) system for use in a wellbore that can be assembled in the wellbore. Upper and lower pump tandems are fitted with connectors that align the tandems when coupled in the wellbore. The connectors on the lower tandems have bores with enlarged openings on upward facing surfaces. Downward pointing pins are on lower facing surfaces of the connectors on the upper tandems. The cross sectional area of each bore decreases with distance away from the openings, so that as the pins insert into the bores the pins move along a helical path that in turn rotates the upper tandem into a designated azimuth and into alignment with the lower tandem. Properly aligning the upper and lower tandems couples respective drive and driven shafts in the tandems as the upper tandem lands on the lower tandem.

18 Claims, 3 Drawing Sheets

CONNECTION ASSEMBLY FOR THROUGH TUBING CONVEYED SUBMERSIBLE PUMPS

RELATED APPLICATIONS

This application claims priority to and the benefit of U.S. Provisional Application Ser. No. 61/424,937, filed Dec. 20, 2010, the full disclosure of which is hereby incorporated by reference herein.

BACKGROUND

1. Field of Invention

This invention relates in general to oil and gas production and in particular to a device for coupling together segments of electrical submersible pumps.

2. Description of Prior Art

An electrical submersible pumping (ESP) system for a hydrocarbon producing well is normally installed within casing on a string of tubing or deployed within the tubing itself. Usually the tubing is made up of sections of pipe screwed together. Coiled tubing deployed from a reel may also be used. The motor is often powered with a power cable that is strapped alongside the tubing. The pump is typically located above the motor, is connected to the lower end of the tubing, and pumps fluid through the tubing to the surface. One type of a pump is a centrifugal pump using a plurality of stages, each stage having an impeller and a diffuser. Another type of pump, for lesser volumes, is a progressing cavity pump.

To contain pressure in the wellbore, ESP systems are typically deployed in a wellbore with the use of a wellhead lubricator. Where the lubricator is generally suspended above an opening to the well using an on-site crane. Safety and environmental concerns limit the maximum length of the lubricator, thereby limiting the size and length of ESPs. Some applications though may require an ESP system to have a length in excess of the maximum length of the lubricator.

SUMMARY OF INVENTION

Disclosed is an embodiment of a method of engaging sections of a pumping system. In one example embodiment the method includes providing a lower section of the pumping system, where the lower section has a connector with a bore on an upper surface that of the connector. The bore has a cross sectional area that decreases with distance away from its opening. The method further includes anchoring the lower section within production tubing disposed in a subterranean well and providing an upper section of the pumping system. The upper section includes a connector with a downward facing pin. The upper section is oriented into a designated azimuth for coupling engagement with the lower section. Orientation takes place by lowering the upper section onto the lower section and inserting the pin into the opening of the bore. The pin follows a generally circular path as it slides to a lowermost portion of the bore that positions the upper section at a designated azimuth for coupling the upper and lower sections. The upper section is engaged to the lower section when the upper section is oriented as desired. In one example, the lower section includes a lower pumping system with a splined drive shaft and the upper section has a driven shaft with splines. In an example embodiment, an annular coupling on the driven shaft has grooves formed on an inner surface and when the upper section is at the designated azimuth, the splines on the drive shaft are aligned with the grooves in the coupling so that the drive shaft can be inserted into a lower end of the coupling. Optionally, fluid can be vented from inside of the coupling when the drive shaft inserts into the coupling. In another alternative embodiment, fluid is pumped from the wellbore by rotating the drive shaft to rotate the driven shaft via the coupling to pressurize the fluid in the lower section and the upper section. An upward force can optionally be applied onto the upper section to disengage the upper section from the lower section. Alternatively, additional sections can be stacked onto the upper section.

Also disclosed is an embodiment of an electrical submersible pumping (ESP) system. In one example, the ESP system is made up of a lower tandem selectively anchored inside of production tubing that is disposed in a wellbore. A drive shaft is included in the lower tandem that has an end that projects past the lower tandem and splines on its outer surface. In this example, a connector is provided on an upper end of the lower tandem has an upward facing bore with an cross sectional area that decreases with distance away from an opening of the bore. An upper tandem is set on the upper end of the lower tandem that has a driven shaft inserted into an annular coupling. A connector is provided on a lower end of the upper tandem that has a strategically located pin that points downward. In this example, when the upper tandem lands on the lower tandem and the pin is inserted into the opening of the bore, the pin slides along a side of the bore to a designated azimuth and aligns the grooves in the coupling with splines on the drive shaft as the coupling slides over the drive shaft. In one alternative, the splines on the drive shaft have an upper end with a pointed tip. A vent is optionally formed through a sidewall of the coupling. In one alternate embodiment, the connectors are threadingly mounted on the respective upper and lower ends of the lower and upper tandems, and the pin and bore are adjacent respective outer edges of the connectors on the upper and lower tandems. One alternate embodiment includes a plurality of upward facing bores on the connector on the lower tandem and arranged proximate one another. Optionally, a plurality of downward facing pins are on the connector on the upper tandem. In this example, when the upper tandem is lowered onto the lower tandem, the pins engage an opening of one of the bores. Alternatively, the bores are disposed proximate an outer surface of the connector on the lower tandem, and the pins are disposed proximate an outer surface of the connector on the upper tandem.

Also provided herein is a through tubing electrical submersible pumping (ESP) system, that in one example embodiment includes a lower tandem pump in selective anchoring within a string of production tubing disposed in a wellbore. A drive shaft with splines is included with the lower tandem pump. A shaft coupling is also included that has an axial passage and grooves formed axially along a sidewall of the passage. The ESP system also includes an upper tandem pump in fluid communication with the lower tandem pump and coupled to an upper end of the lower tandem pump having a driven shaft with a lower end engagedly inserted into the shaft coupling. Connectors are provided on the respective upper and lower ends of the lower and upper tandem pumps for azimuthally orienting the upper tandem so the grooves in the shaft coupling align with splines on the drive shaft as the upper tandem is lowered on to the lower tandem. In one example embodiment, the means for orienting the upper tandem include a series of bores that are disposed along a substantially circular path on an upper surface of the lower tandem. In this example, the path is proximate an outer periphery of the lower tandem. Optionally, the means for orienting the upper tandem includes downwardly pointing pins provided along a substantially circular path on a lower surface of the upper tandem. In this embodiment the path is proximate an outer periphery of the upper tandem. Thus when lowered into the bores, the pins slide in a circular path along a side of the bores to a lowermost position and in a designated azimuth.

DETAILED DESCRIPTION OF THE INVENTION

The present invention will now be described more fully hereinafter with reference to the accompanying drawings in which embodiments of the invention are shown. This invention may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout.

Figure 1:
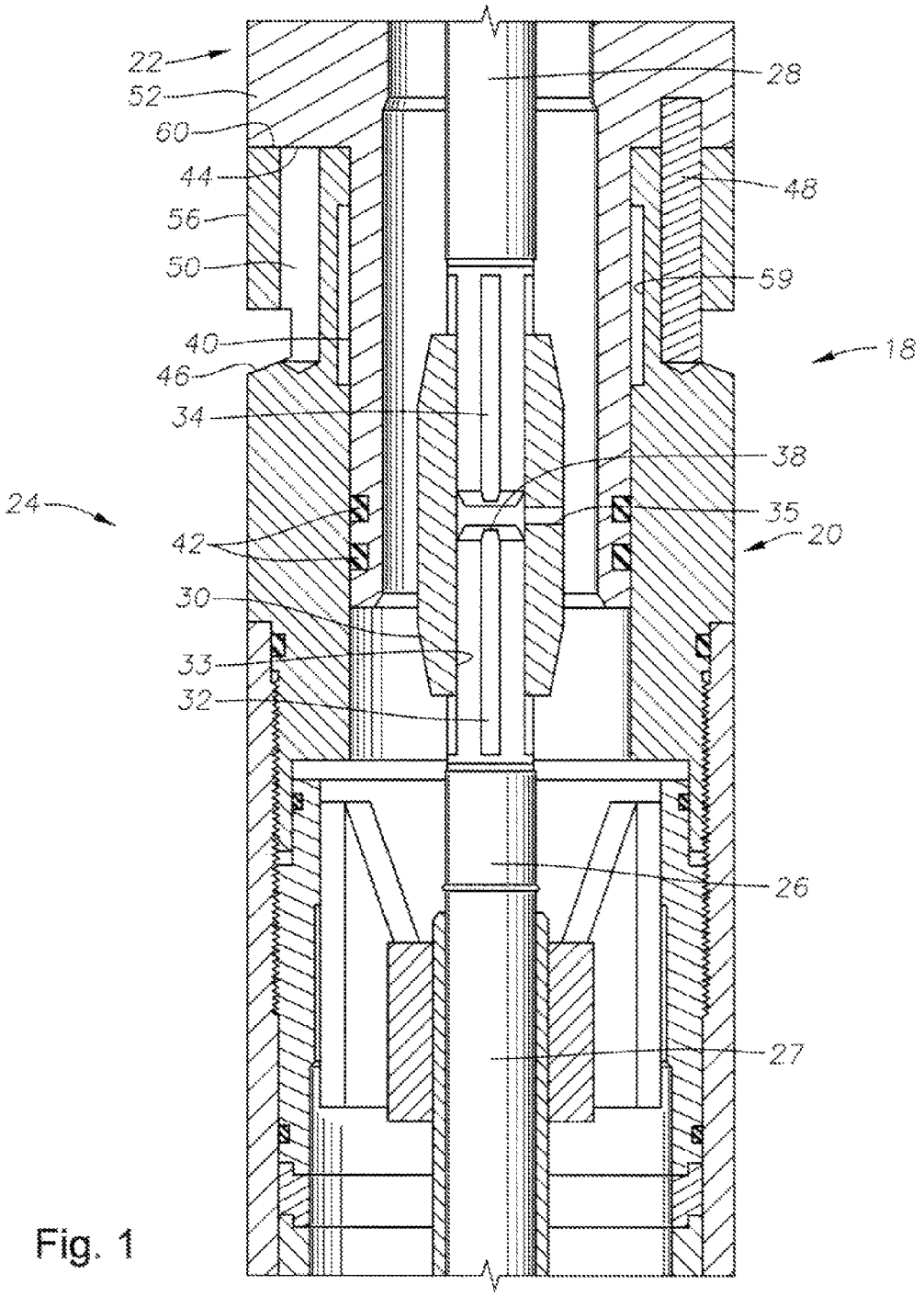
FIG. 1 is a side sectional view of a connection assembly for a submersible pumping system disposed in a wellbore.

FIG. 1 is a side sectional view of a connection assembly 18 for connecting a lower tandem 20 to an upper tandem 22, which make up a part of a through tubing conveyed (TTC) pumping system 24. A drive shaft 26 is shown coaxially within the lower tandem 20 and held in place by a bearing assembly 27. The drive shaft 26 is mechanically coupled to a driven shaft 28 shown set coaxial within the upper tandem 22. An annular coupling 30 has a lower end and in which an upper end of the drive shaft 26 is inserted. A lower end the driven shall 28 is shown inserted in an upper end of the annular coupling 30. In the example of FIG. 1, the drive shaft 26 and driven shaft 28 are maintained substantially coaxial by the annular coupling 30. Splines 32 shown extending substantially lengthwise along the upper end of the drive shaft 26 mate with grooves or channels 33 provided lengthwise on an inner surface of the coupling 30. Similarly, splines 34 are formed lengthwise along the lower end of the driven shaft 28 and encounter grooves or channels (not shown) lengthwise in the coupling 30 thereby mechanically affixing the drive shaft 26 with the driven shaft 28. An optional set screw (not shown) may be included for attaching the coupling 30 to the driven shaft 34. A vent 35 is optionally formed through a sidewall of coupling 30.

In the example of FIG. 1, the upper end of the splines 32 narrow to an upward facing edge to form points 38. The reduced cross sectional area of the points 38, over that of a "non-pointed" and planar spline embodiment, eases mounting the coupling 30 onto the upper end of the drive shaft 32 by removing potentially interfering structure. The pointed upper ends minimize potential contact surfaces to reduce potential surface contact resistance when inserting the drive shaft 32 into the coupling 30.

On the lower end of the upper tandem 22 is a sealing stinger 40, which is illustrated as an annular extension and protruding a distance within the opening on the upper end of the lower tandem 20. The stinger 40 of FIG. 1 has an outer diameter configured for sealing contact with the inner circumference of the opening within the lower tandem 20. Optionally, seals 42 shown on the outer periphery of the sealing stinger 40 may be included to ensure a sealing contact between the lower and upper tandems 20, 22. As shown in FIG. 1, the periphery of the stinger 40 is set radially inward from the outer circumference of the upper tandem 22, thereby defining a downward facing annular shoulder 44 on the outer circumference of a connector 520 of the upper tandem 22. As shown in the coupled configuration of FIG. 1, the annular shoulder 44 lies in a plane that is substantially perpendicular to an axis AX of the connection assembly 18. The annular shoulder 44 is shown resting on an upper end of a connector 56 that makes up the upper end of the lower tandem 20.

Still referring to FIG. 1, cylindrically shaped pins 48 are shown projecting downward from within the annular shoulder 44. Alignment holes or bores 50 are formed within the connector 56 and substantially aligned with the axis AX of the connection assembly 18 and the pins 48. Thus, when the upper and lower tandems 20, 22 are coupled; the pins 48 are inserted within the alignment bores 50. In the embodiment of FIG. 1, the lower ends of the alignment bores 50 are open to the an annular recess 46 formed on the exterior of the connector 56.

Figure 2:
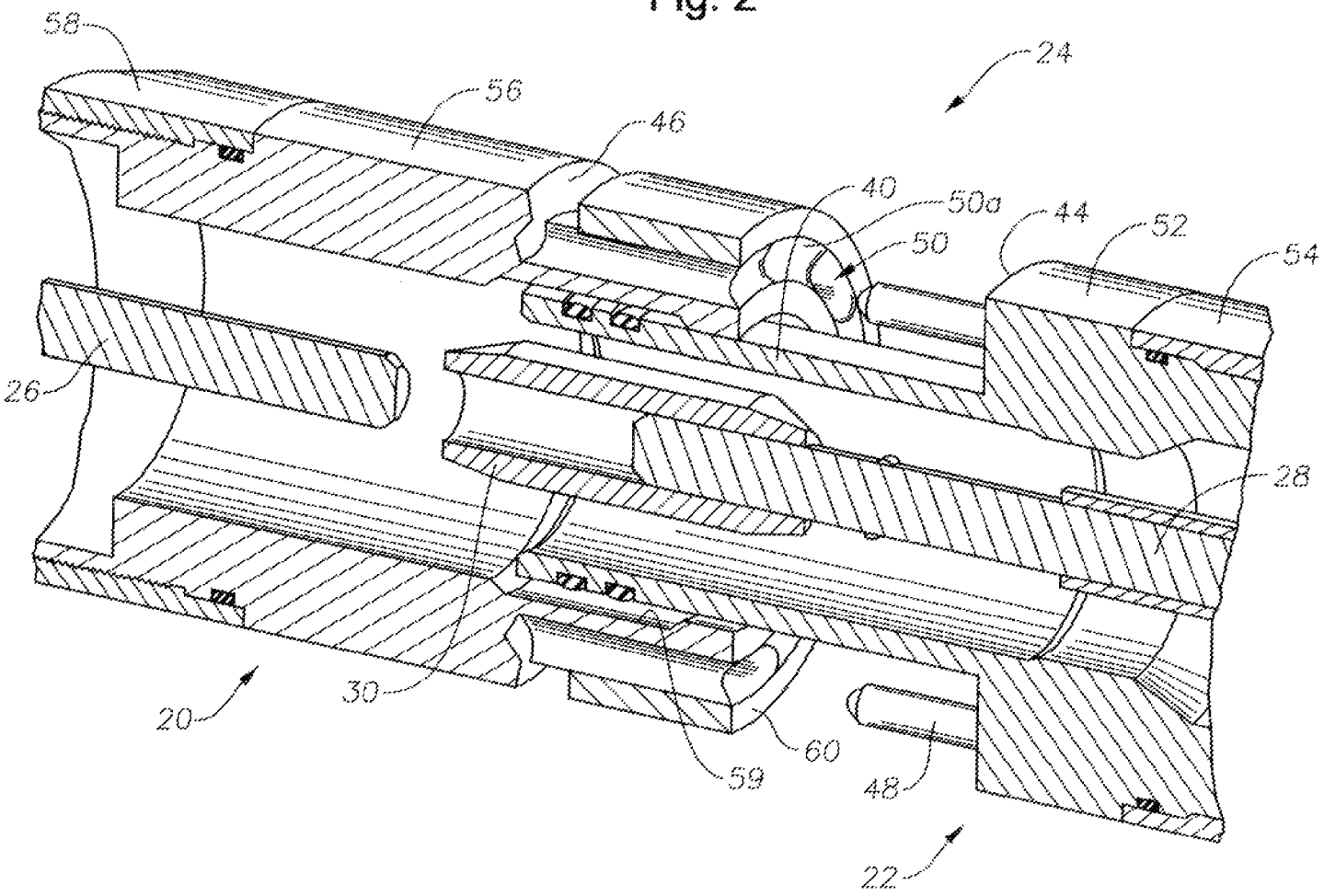
FIG. 2 is a sectional perspective view of an embodiment of the connection assembly of FIG. 1.

Referring now to FIG. 2, the pumping assembly 24 of FIG. 1 is shown in a perspective and partial sectional view. The assembly 24 of FIG. 2 is not in a coupled configuration; instead the upper tandem 22 is only partially inserted in with the lower tandem 20 and illustrates an example stage of coupling or decoupling the upper and lower tandems 20, 22. More specifically, the lower end of the sealing stringer 40 is inserted within the opening of the lower tandem 20 and with its lower end just past the upper end of the connector 56. Accordingly, the coupling 30, which is secured to the driven shaft 28 by the set screw is still above the upper end of the drive shaft 26. Additionally, the pins 48 are above the alignment bores 50 and out of contact with the connector 56. The embodiment of FIG. 2 illustrates the lower end of the upper tandem 22 to include a selectively attachable male connector 52 that can be threadingly attached to a housing 54 that houses the upper tandem 22. Thus in one example embodiment, the male connector 52 includes the sealing stinger 40, annular shoulder 44, and pins 48.

Similar to the male connector 52, the upper end of the lower tandem 20 is fitted with female connector 56, which is threadingly coupled with housing 58 on the outer surface of the lower tandem 20. The lower tandem 20 can be deployed or removed from a wellbore by coupling a wireline tool (not shown) with a profile 59 illustrated on an inner surface of the female connector 56 The female connector 56, which is shown an annular element, may be replaced with other designs or configurations mounted on the end of the lower tandem 20. As seen in the embodiment of FIG. 2, the alignment bores 50 project into the female connector 56 from a mating surface or annular shoulder 60 on the upper terminal end of the female connector 56. Also, when the upper and lower tandems 20, 22 are attached, the annular shoulder 44 is in contact with the mating surface 60. The alignment bores 50 are shown having a wide opening or circumferentially tapered entrance portion 50*a* at their upper section and have a cross sectional area that narrows with distance away from the mating surface 60 to define a lower section with cross sectional dimensions more approximate that of the pins 48 than the upper section of the bores 50. Entrance portion 50*a* extends circumferentially along mating surface 60 a selected distance that is greater than a diameter or cross section of the lower, longitudinally extending portion of each alignment bore 50. So that when the pin 48 is received within the opening 50*a* of the alignment bore 50, the varying cross sectional profile of each entrance portion 50*a* of each bore 50 guides the lower end of each pin 48 along a helical path so that the grooves or channels within the coupling 30 are aligned with the splines 32 on the drive shaft 26. Strategically positioning the pins 48 and profiling of the bores 50 enables alignment and coupling when the upper tandem 22 is landed onto the lower tandem 20, even when the pins 48 are azimuthally offset from the lower section of the bores 50. The pin 48 or pins 48 of FIGS. 1 and 2 could be a single pin or multiple pins. The alignment of the pins 48 and the splines 32 are independent as the tandems 20, 22 are made up. The upper tandem 22 may rotate in one direction, such as clockwise, while the coupling 30 and splines 32 may rotate in an opposite, or counter-clockwise direction, depending on the respective initial orientation of the upper tandem 22, coupling 30, and splines 32.

Figure 3:
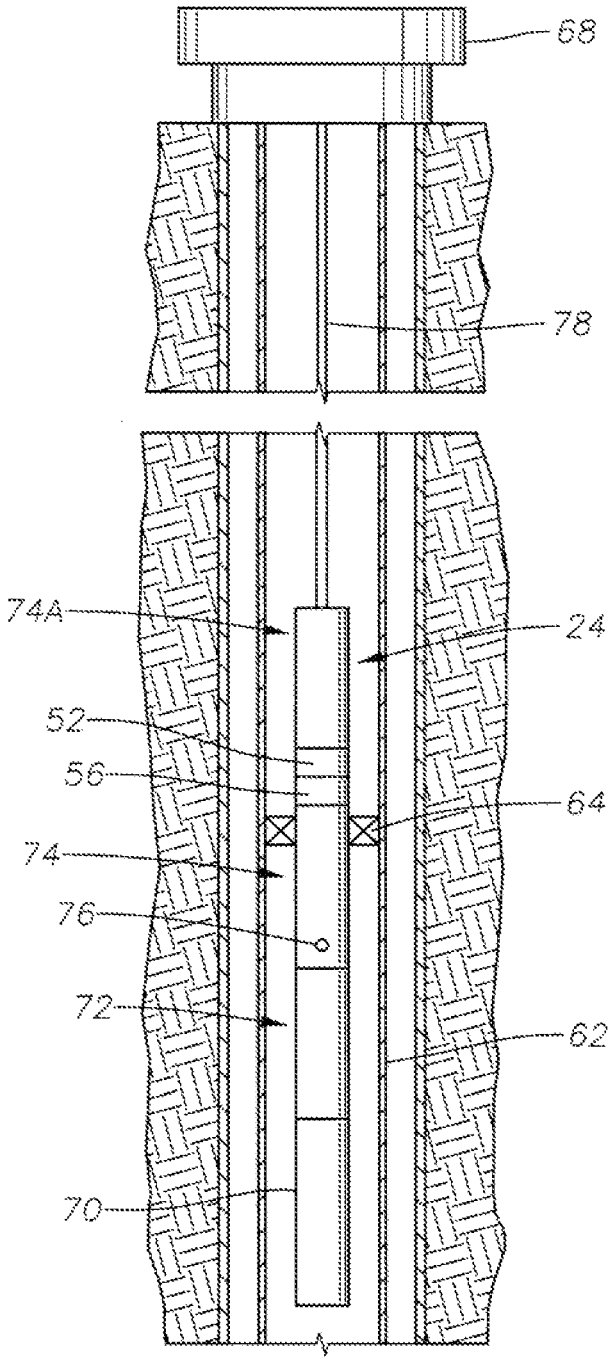
FIG. 3 is a side partial section view of tandem submersible pumping systems being coupled together.

FIG. 3 is a partial sectional view of an example of a pumping system 24 set within tubing 62 that is deployed within a wellbore. In the example of FIG. 3, the lower tandem 20 represents a stand alone through tubing conveyed pumping system set within the tubing 62 and having a packer 64 set in the annular space between the lower tandem 20 and inner surface of the tubing 62. A casing 66 circumscribes the tubing 62 within the wellbore, wherein the tubing 62 and casing 66 each are supported from the surface from a wellhead assembly 68. The lower tandem 20 of FIG. 3 is made up of a motor section 70 having a motor for driving the drive shaft 26 (FIGS. 1 and 2), a seal section 72 set on an upper end of the motor section 70, and a pump section 74 on the upper end of the seal section 72. In the embodiment of FIG. 3, the female connector 56 is mounted on an upper end of the pump section 74. Further illustrated in the example of embodiment of FIG. 3 is a fluid inlet 76 on the housing of the pump section 74 for receiving wellbore fluid to be pumped.

The upper tandem 22 is shown as a pump section 74A similar to the pump section 74 of the lower tandem 20. Accordingly, the male connector 52 is shown mounted on a lower end of the pump section 74A. The upper tandem 22 of FIG. 3 is shown being deployed within the tubing 62 from a wireline 78 that can be used for raising and lowering the pump assembly 24. In the example of FIG. 3, the wireline 78 is shown suspended through the wellhead assembly 68. Assembling a multi-tandem submersible pump using the connection systems provided herein allows for staging of pumps within the well bore and without the need of staging above the wellhead 68.

In one example embodiment of operation, the lower tandem 20, with an intake surface installed can be deployed in the tubing 62 and anchored therein, such as with the packer 64. In this example, the collar 46 is provided on an upper end of the lower tandem 20 with alignment bores 50 facing upward. The upper tandem 22 can then be lowered onto the anchored lower tandem 20, where the male connector 52 with downward facing pins 48 can engage the bores 50 to rotate the upper tandem 22 into a designated azimuth so that the coupling 30 on the driven shaft 28 can align with and engagingly slide over the drive shaft 26 to fully couple the lower and upper tandems 20, 22. In addition to azimuthally orienting the upper tandem 22, the pins 48 can also prevent the tandems 20, 22 from rotating with respect to one another during pumping operations. Alternatively, a series of middle tandem pumps (not shown) can be set on the lower tandem 20 for purposes of adding to the stage count. An upper tandem pump can be set on the middle tandem pumps. A pressure segregating apparatus can be strategically disposed in the annular space between the pumps and wellbore. Further, an anchoring device, such as like a packer assembly, can be set on the pumps.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. For example, the pins 48 could have lower ends that are pointed. Optionally, the pins 48 could have shapes or profiles that vary along their lengths. These and other similar modifications will readily suggest themselves to those skilled in the art, and are intended to be encompassed within the spirit of the present invention disclosed herein and the scope of the appended claims.

The invention claimed is:

1. A method of installing a subterranean pumping system comprising:

a. providing a lower pump and an upper pump of the pumping system, the lower pump having at an upper end a central lower pump bore coaxial with an axis of the pumping system, and an annular upward facing shoulder surrounding the lower pump bore, the upper pump having on a lower end a central upper pump bore coaxial with the axis and an annular downward facing shoulder surrounding the central upper pump bore, each of the pumps having a drive shaft located on the axis, each of the drive shafts having a splined end, and an internally splined coupling sleeve carried on one of the splined ends for receiving the other of the splined ends;

b. mounting at least one cylindrical guide pin to one of the shoulders and forming at least one guide hole in the other of the shoulders, the guide hole having a circumferentially tapered entrance portion leading to a longitudinally extending portion, the entrance portion extending circumferentially a distance greater than a cross section of the longitudinally extending portion;

c. the anchoring the lower pump within production tubing disposed in a subterranean well; then d. lowering the upper pump down the production tubing onto the lower pump, inserting the pin into the entrance portion of the guide hole, and sliding the pin along the entrance portion and into the longitudinally extending portion of the guide hole, causing an increment of rotation of the upper pump relative to the lower pump; and e. while performing step (d), stabbing the other of said splined ends into the internally splined coupling.

2. The method of claim 1, wherein step (b) comprises providing an annular recess of an exterior surface of the connector of the lower pump that intersects the longitudinally extending portion of the guide hole and opens the longitudinally extending portion of the guide hole to the exterior surface.

3. The method of claim 1 further comprising, venting fluid from inside of the coupling when said other of the splined ends inserts into the coupling.

4. The method of claim 1 further comprising, pumping fluid from the wellbore by rotating the drive shaft of the lower pump to rotate the drive shaft of the upper pump via the coupling, and pressurize the fluid in the lower pump and the upper pump.

5. The method of claim 1 further comprising retrieving the upper pump from the production tubing by lifting the upper pump to disengage the upper pump form the lower pump.

6. The method of claim 1, wherein when the upper pump is fully connected with the lower pump after step (e), the upper pump is free to move axially upward relative to the lower pump, and the guide pin inserted within the guide hole prevents rotation of the upper pump relative to the lower pump during operation.

7. The method according to claim 1, wherein step (b) comprises mounting a plurality of the guide pins to said one of the shoulders and forming a plurality of the guide holes in the other of said shoulders.

8. The method according to claim 1, wherein step (b) comprises mounting the guide pin to the shoulder of the upper pump and forming the guide hole in the shoulder of the lower pump.

9. The method according to claim 1, wherein:

step (c) further comprises operatively connecting a motor to a lower end of the lower pump; and the method further comprises:

supplying power to the motor to rotate the drive shaft of the lower pump.

10. An electrical submersible pumping (ESP) system comprising:

a lower tandem pump adapted to be anchored inside of production tubing that is disposed in a wellbore;

a drive shaft in the lower tandem pump having an end extending upward past an end of the lower tandem pump with splines formed axially along an outer surface of the end of the lower tandem pump;

a lower connector on an upper end of the lower tandem pump having a central bore concentric with an axis of the lower tandem pump, and an annular upward facing shoulder surrounding the central bore of the lower connector;

an upper tandem pump adapted to be lowered through the production tubing and landed on the upper end of the lower tandem pump;

an upper connector on a lower end of the upper tandem pump having a central bore concentric with the axis and an annular downward facing shoulder surrounding the central bore of the upper connector;

an annular coupling with a passage axially formed therethrough and grooves provided on a sidewall of the passage that mate with the splines on the end of the drive shaft;

a driven shaft in the upper tandem pump having an end inserted into the annular coupling and splines formed axially along an outer surface of the driven shaft that mate with the grooves in the annular coupling;

at least one guide hole in one of the shoulders, the guide hole having a circumferentially tapered entrance portion leading to a longitudinally extending portion, the entrance portion extending circumferentially a greater distance than a cross section of the longitudinally extending portion; and at least one longitudinally extending guide pin protruding from the other of the shoulders, so that when the upper tandem pump lands on the lower tandem pump the pin slides along the entrance portion of the guide hole and the upper pump rotates relative to the lower pump until the pin is aligned with the longitudinally extending portion of the guide hole, then slides into the longitudinally extending portion of the guide hole.

11. The ESP system of claim 10, wherein the splines on the drive shaft have an upper end with a pointed tip.

12. The ESP system of claim 10, further comprising a vent formed through a sidewall of the coupling.

13. The ESP system of claim 10, wherein the connectors prevent rotation of the upper tandem pump relate to the lower tandem pump during operation but allow upward movement of the upper tandem pump relative to the lower tandem pump.

14. The ESP system of claim 10, wherein:

said at least guide hole comprises a plurality of guide holes; and said at least one guide pin comprises a plurality of guide pins.

15. The ESP system of claim 14, wherein the guide holes are formed in the upward facing shoulder, and the guide pins protrude from the downward facing shoulder; and the system further comprises:

an annular recess formed in an exterior surface of the connector of the lower tandem pump, the recess intersecting and opening the longitudinally extending portions of the guide holes to the exterior surface.

16. A through tubing electrical submersible pumping (ESP) system comprising:

a lower tandem pump adapted to be anchored within a string of production tubing disposed in a wellbore, the lower tandem pump having a drive shaft with splines on an upper end;

a motor operatively coupled to the lower tandem pump for rotating the drive shaft;

a shaft coupling with an axial passage and grooves formed axially along a sidewall of the passage, the upper end of the drive shaft being inserted into the shaft coupling;

an upper tandem pump adapted to be lowered through the production tubing and landed on the lower tandem pump, the upper tandem pump having a driven shaft with splines on a lower end, the lower end of the driven shaft being inserted into the shaft coupling;

deploying means for lowering the upper tandem pump on a line through the production tubing and landing the upper tandem pump on the lower tandem pump;

connectors provided on the respective upper and lower ends of the lower and upper tandem pumps having a means for azimuthally orienting the upper tandem pump while landing on the lower tandem pump, and for preventing rotation of the upper tandem pump relative to the lower tandem pump while the connectors are in a fully engaged position and the motor is rotating the drive shaft; and wherein wherein while in the fully engaged position, the connectors allow upward movement of the upper tandem pump relative to the lower tandem pump to retrieve the upper tandem pump with the deploying means.

17. The ESP system of claim 16, wherein the means for orienting the upper tandem pump comprise a series of guide holes that are disposed along a substantially circular path on the connector of one of the tandem pumps and a plurality of longitudinally extending pins on the connector of the other of the tandem pumps that mate with the guide holes, each of the guide holes having a circumferentially tapered entrance portion leading to a longitudinally extending portion, the entrance portion extending circumferentially a greater distance than a cross section of the longitudinally extending portion.

18. The ESP system of claim 17, wherein the guide holes are formed in the connector of the lower tandem pump; and wherein the system further comprises:

an annular recess formed in an exterior surface of the connector of the lower tandem pump, the recess intersecting and opening the longitudinally extending portions of the guide holes to the exterior surface.

* * * * *

UNITED STATES PATENT AND TRADEMARK OFFICE

CERTIFICATE OF CORRECTION

PATENT NO. : 9,080,436 B2
APPLICATION NO. : 13/297979
DATED : July 14, 2015
INVENTOR(S) : Steven K. Tetzlaff et al.

It is certified that error appears in the above-identified patent and that said Letters Patent is hereby corrected as shown below:

In the Specification
Column 2, line 15, delete "is" before "provided"
Column 3, line 34, delete "shall" and insert --shaft--
Column 4, line 43, insert a --.-- after "56"
In the Claims
Column 6, line 31, delete "the" before "anchoring"
Column 8, line 39, delete "wherein" before "while"

Signed and Sealed this
Ninth Day of August, 2016

Michelle K. Lee

Michelle K. Lee
*Director of the United States Patent and Trademark Office*